US006404391B1

(12) United States Patent
Apostolos

(10) Patent No.: US 6,404,391 B1
(45) Date of Patent: Jun. 11, 2002

(54) MEANDER LINE LOADED TUNABLE PATCH ANTENNA

(75) Inventor: John Apostolos, Merrimack, NH (US)

(73) Assignee: BAE Systems Information and Electronic System Integration INC, Nashua, NH (US)

( * ) Notice: Subject to any disclaimer, the term of this patent is extended or adjusted under 35 U.S.C. 154(b) by 0 days.

(21) Appl. No.: 09/900,830

(22) Filed: Jul. 6, 2001

Related U.S. Application Data

(60) Provisional application No. 60/264,347, filed on Jan. 25, 2001.

(51) Int. Cl.[7] ..... H01Q 1/38

(52) U.S. Cl. ..... 343/700 MS; 343/741; 343/744; 343/745

(58) Field of Search ..... 348/700 MS, 728, 348/741, 742, 743, 744, 745, 749, 829, 846, 866, 867; H01Q 1/24, 1/38

(56) References Cited

U.S. PATENT DOCUMENTS

| | | | | |
|---|---|---|---|---|
| 3,633,207 A | * | 1/1972 | Ingerson | 343/770 |
| 3,754,197 A | | 8/1973 | Cristal | |
| 3,849,745 A | | 11/1974 | Schellenberg et al. | |
| 4,257,049 A | | 3/1981 | Kuo | |
| 4,293,858 A | | 10/1981 | Hockman | |
| 4,821,041 A | | 4/1989 | Evans | |
| 5,541,614 A | | 7/1996 | Lam et al. | |
| 5,754,143 A | | 5/1998 | Warnagiris et al. | |
| 5,777,581 A | | 7/1998 | Lilly et al. | |
| 5,790,080 A | | 8/1998 | Apostolos | |
| 5,867,126 A | * | 2/1999 | Kawahata et al. | 343/702 |
| 5,892,490 A | | 4/1999 | Asakura et al. | |
| 5,926,139 A | * | 7/1999 | Korisch | 343/702 |
| 5,936,587 A | * | 8/1999 | Gudilev et al. | 343/752 |
| 5,949,303 A | | 9/1999 | Arvidsson et al. | |
| 6,005,519 A | | 12/1999 | Burns | |
| 6,008,762 A | | 12/1999 | Nghiem | |
| 6,034,637 A | | 3/2000 | McCoy et al. | |
| 6,061,035 A | * | 5/2000 | Kinasewitz et al. | 343/853 |
| 6,069,587 A | | 5/2000 | Lynch et al. | |
| 6,094,170 A | | 7/2000 | Peng | |
| 6,097,347 A | | 8/2000 | Duan et al. | |
| 6,166,694 A | * | 12/2000 | Ying | 343/702 |
| 6,323,814 B1 | * | 11/2001 | Apostolos | 343/744 |

FOREIGN PATENT DOCUMENTS

| | | |
|---|---|---|
| WO | WO 01/13464 | 2/2001 |

OTHER PUBLICATIONS

PCT International Search Report dated Oct. 17, 2001 of International Application No. PCT/US01/41279, filed Jul. 16,2001.

* cited by examiner

*Primary Examiner*—Tho G. Phan
(74) *Attorney, Agent, or Firm*—Scott J. Asmus; Vernon C. Maine

(57) ABSTRACT

The present invention features a compact tunable meander line loaded patch antenna where switches or the like are used to electrically connect and disconnect sections of the meander line adjusting the electrical length of the antenna. A fixed or switched series capacitance is used to overcome the inductance of the meander line. In one embodiment, a quarter wavelength mode patch antenna can be constructed which occupies significantly less space than conventional patch antennas. This size reduction is important when the antennas are to be used on mobile platforms where real estate is at a premium and larger antennas cannot be used.

20 Claims, 7 Drawing Sheets

MEANDER LINE LOADED TUNABLE PATCH ANTENNA

CROSS REFERENCE TO RELATED APPLICATIONS

This application claims priority to U.S. Provisional Patent Application Serial No. 60/264,347, filed Jan. 25, 2001. This application is also related to U.S. Pat. No. 5,790,080 for MEANDER LINE LOADED ANTENNA, which is hereby incorporated by reference.

FIELD OF THE INVENTION

This invention pertains to the field of antennas and more particularly, to a meander line loaded antenna configured as a small, tunable patch antenna.

BACKGROUND OF THE INVENTION

Microstrip patch antennas are known in the art, and generally have a dielectric substrate with a ground plane on one surface and a strip conductor feeding a large patch. The patch is generally large, with the length being a little less than half a wavelength at the operating frequency and the width selected for the appropriate radiating resistance.

Suspended patch antennas are also known in the art, wherein the patch is suspended substantially parallel and above the ground plane. The suspended design has an increased efficiency, but is otherwise restrained with the limitations of the standard patch antenna, namely being relatively large.

In the prior art, efficient antennas have typically required structures with minimum dimensions on the order of a quarter wavelength of their intended radiating frequency. These dimensions allowed the antennas to be easily excited and to be operated at or near their resonance, limiting the energy dissipated in resistive losses and maximizing the transmitted energy. These antennas tended to be large in size at their resonant wavelengths. Further, as the operating frequency decreased, the antenna's dimensions were increased proportionally.

In order to address the shortcomings of traditional antenna design and functionality, the meander line loaded antenna (MLA) was developed. The basic theory and design of the MLA is presented in U.S. Pat. No. 5,790,080. An example of a basic MLA, also known as a variable impedance transmission line (VITL) antenna, is shown in FIG. 1, generally at reference number 100. The antenna 100 consists of two vertical sections (i.e., plates) 102 and a horizontal section 104. The vertical and horizontal sections 102, 104, respectively, are separated by gaps 106. Also part of the antenna 100 are meander lines 200 (FIG. 2), which are typically connected between at least one of the vertical sections 102 and the horizontal section 104 at the gaps 106.

The meander line 200 is designed to adjust the electrical (i.e., resonant) length of the antenna 100. In addition, it is possible to switch lengths of the meander line 200 in or out of the circuit quickly and with negligible loss in order to change the effective electrical length of the antenna 100. This switching is possible because the active switching devices (not shown) are usually located in the high impedance sections of the meander line 200. This keeps the current through the switching devices (not shown) low and results in very low dissipation losses in the switches, thereby maintaining high antenna efficiency. Switching of sections of a meander line using microelectromechanical systems (MEMS) switches or the like are well known to those skilled in the antenna design arts.

The basic antenna of FIG. 1 can be operated in a loop mode that provides a 360° coverage (i.e., radiation) pattern. Horizontal polarization, loop mode, is obtained when the antenna is operated at a frequency such that the electrical length of the entire line including the meander lines 200 is a multiple of full wavelength, as shown in FIG. 3C. The antenna can also be operated in a vertically polarized, monopole mode by adjusting the electrical length to an odd multiple of a half wavelength at the operating frequency, FIGS. 3B and 3D, respectively. The meander lines 200 can be tuned using electrical or mechanical switches (not shown) to change the mode of operation at a given frequency or to switch frequencies using a given mode.

The invention of the meander line loaded antenna allowed the physical antenna dimensions to be significantly reduced in size while maintaining electrical lengths that were still multiples of a quarter wavelength. Antennas and radiating structures built using this design approach operate in the region where the limitation on their fundamental performance is governed by the Chu-Harrington relation:

$$\text{Efficiency}=FV_2Q$$

where:

Q=Quality Factor;

$V_2$=Volume of the structure in cubic wavelengths; and

F=Geometric Form Factor (F=64 for a cube or a sphere)

Meander line loaded antennas achieve the efficiency limit of the Chu-Harrington relation while allowing the antenna size to be much smaller than a wavelength at the frequency of operation. Height reductions of 10 to lower quarter wave monopole antennas are achieved while realizing comparable gain.

The existing MLA antennas are narrow band antennas. While the patch antennas have a greater bandwidth, they are too large to be useful in certain size constrained applications.

DISCUSSION OF RELATED ART

U.S. Pat. No. 5,790,080 entitled MEANDER LINE LOADED ANTENNA, describes an antenna that includes one or more conductive elements for acting as radiating antenna elements. Also provided is a slow wave meander line adapted to couple electrical signals between the conductive elements, wherein the meander line has an effective electrical length that affects the electrical length and operating characteristics of the antenna. The electrical length and operating mode of the antenna may be readily controlled.

A tunable microstrip patch antenna is described in U.S. Pat. No. 5,777,581. The patch is configured with numerous switchable microstrips. The resonant frequency of the patch is inversely proportional to the total effective patch length including the microstrip sections. Switching the microstrips changes the properties of the antenna allowing the resonant frequency to be manipulated. Other tunable microstrip patch antennas include U.S. Pat. No. 6,005,519 and U.S. Pat. No. 4,821,041.

U.S. Pat. No. 6,034,637 describes a double resonant wideband patch antenna that includes a planar resonator forming a substantially trapezoidal shape having a non-parallel edge for providing a substantially wide bandwidth. A feed line extends parallel to the non-parallel edge for coupling, while a ground plane extends beneath the planar resonator for increasing radiation efficiency.

U.S. Pat. No. 6,008,762 describes a folded quarter-wave patch antenna that includes a conductor plate having first and second spaced apart arms. A ground plane is separated from the conductor plate by a dielectric substrate that is approximately to the conductor plate. The ground plane is electrically connected to the first arm at one end and a signal unit is also electrically coupled to the first arm. The signal unit transmits and/or receives signals having a selected frequency band. The folded quarter-wave patch antenna can also act as a dual frequency band antenna. In dual frequency band operation, the signal unit provides the antenna with a first signal of a first frequency band and a second signal of a second frequency band.

Thus, the prior art inventions have been unable to produce small patch antennas. The small patch antennas are necessary in certain applications. What is needed is a small patch antenna with comparable characteristics and capabilities of the larger conventional patch antennas.

SUMMARY OF THE INVENTION

The antenna of the present invention differs from those of the prior art in that it includes a meander line allowing a physical length significantly smaller than its electrical length at its resonant frequency. This is accomplished by using switches to adjust the electrical length of the meander line. The invention also includes a fixed or switched capacitance to cancel meander line inductance. The net effect is that the size of the inventive antenna is significantly smaller than a conventional patch antenna at a particular operating frequency.

In accordance with the present invention there is provided a meander line loaded patch antenna where microelectromechanical systems switches or the like are used to electrically connect and disconnect sections of the meander line from the circuit. A capacitance value calculated for the resonant frequency provides compensation for inductive reactance of the meander line over a fairly wide range. Also, switching series capacitors are within the scope of the invention. By using these techniques, a quarter wave mode patch antenna may be constructed which occupies significantly less space than do conventional meander line loaded antennas. This size reduction is important when the antennas are to be used on mobile platforms where real estate is at a premium and larger antennas cannot be used.

It is therefore an object of the invention to provide a meander line loaded tunable patch antenna, comprising a pair of vertical sections disposed substantially perpendicular to a ground plane, at least one of the pair of vertical sections being electrically connected to the ground plane with a substantially horizontal top section disposed above and substantially perpendicular to the pair of vertical sections and each end of the top section being proximate one of the pair of vertical sections and electrically separated therefrom by a gap. There is at least one meander line proximate at least one of the gaps and operatively connected to one of the vertical sections and to the top section, the meander line comprising at least two portions selectively electrically connectable one to the other. A meander line switching means is disposed between the portions of the meander line for electrically connecting a first of the portions to a second of the two portions. Finally, there is at least one series capacitor operatively connected to at least one of the two portions of the meander line.

Another object is the meander line loaded tunable patch antenna, wherein the meander line switching means comprises at least one from the group: diode, relay, microelectromechanical systems (MEMS) switch.

A further object is the meander line loaded tunable patch antenna, wherein at least one series capacitor is operatively connected to at least one of the portions of the meander line and is calculated to effectively cancel a meander line inductance. The meander line loaded tunable patch antenna has physical dimensions much smaller than one quarter wavelength at a predetermined operating frequency and is tuned by selectively electrically adding and removing at least one of the portions of the meander line using the meander line switching means.

An object includes at least two series capacitors, at least one of the series capacitors being operatively connected to at least one meander line by a capacitance switching means. The capacitance switching means comprises at least one from the group: diode, relay, microelectromechanical systems (MEMS) switch. The series capacitors are calculated to effectively cancel the meander line inductance by selectively electrically adding and removing the series capacitor using the capacitance switching means.

An additional object is the meander line loaded tunable patch antenna, wherein the meander line switching means is located on a high impedance section of the meander line. And, where the meander line is affixed to a sheet of dielectric material disposed between the meander line and the horizontal top section. There can also be sections of dielectric material disposed at a junction between the pair of vertical sections and the ground, and also sections of dielectric material disposed at each gap.

An object of the invention is a meander line loaded tunable patch antenna, comprising a pair of vertical sections disposed substantially perpendicular to a ground plane, at least one of the pair of vertical sections being electrically connected to the ground plane, with a substantially horizontal top section disposed above and substantially perpendicular to the pair of vertical sections with each end of the top section being proximate one of the pair of vertical sections and electrically separated therefrom by a gap. There is at least one printed circuit meander line proximate at least one of the gaps and operatively connected to one of the vertical sections and to the top section, the meander line comprising at least two portions selectively electrically connectable one to the other with a meander line switching means disposed between the portions of the meander line for electrically connecting a first of the portions to a second of the portions. At least one series capacitor is operatively connected to at least one of the portions of the meander line. An advantage of using the printed circuit board is that the printed circuit meander line is attached directly to the horizontal top section.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

BRIEF DESCRIPTION OF THE DRAWINGS

A complete understanding of the present invention may be obtained by reference to the accompanying drawings when considered in conjunction with the subsequent detailed description, in which.

DETAILED DESCRIPTION OF THE PREFERRED EMBODIMENT

The present invention provides a MLA tunable patch antenna designed for quarter wavelength mode operation having a tunable meander line that allows a significant size reduction over similar antennas of the prior art. These reduced size antennas are particularly useful for use on mobile platforms where space may be limited.

Figure 1:
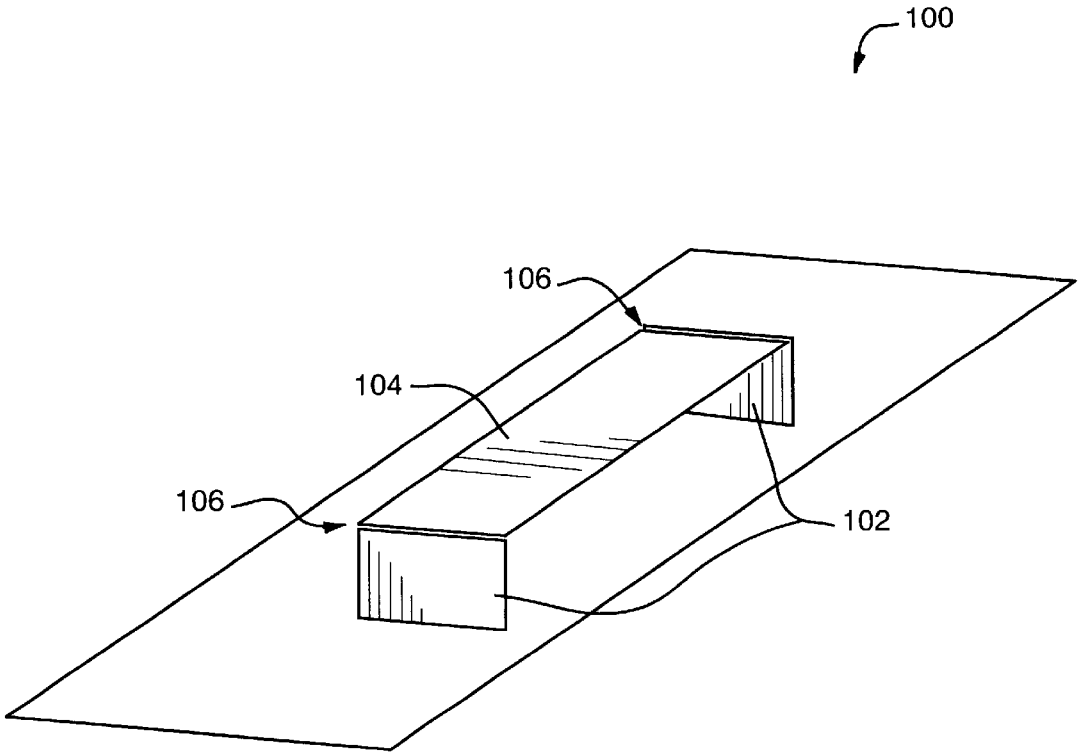
FIG. 1 (PRIOR ART)
FIG. 1 is a schematic, perspective view of a simple MLA loop antenna of the prior art.
Figure 2:
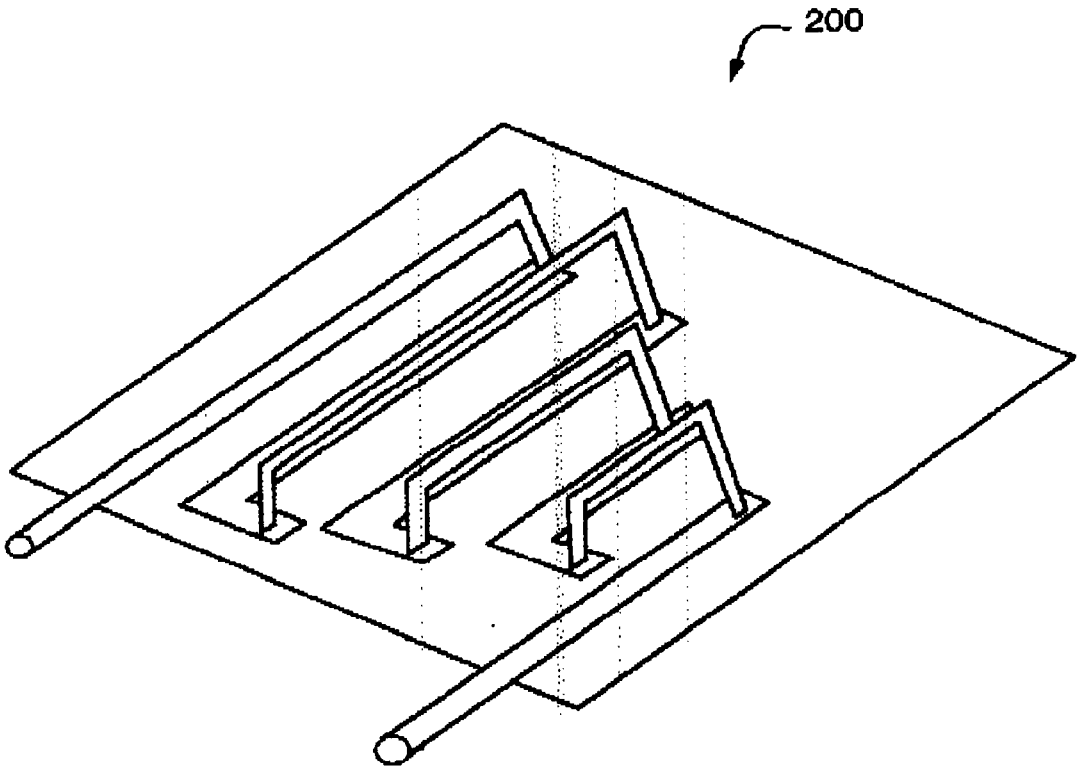
FIG. 2 (PRIOR ART)
FIG. 2 is a schematic, perspective of a meander line structure suitable for use with the antenna of FIG. 1.

Referring again to FIGS. 1 and 2, there are shown cross-sectional, schematic views of an MLA loop antenna 100 of the prior art (FIG. 1) and an associated varied impedance line section 200 (FIG. 2) (i.e., a meander line) suitable for use with the antenna 100. The meander line 200 is located at the gaps 106 of the antenna 100. The meander line 200 has a number of loop sections and can be subdivided into further subsections and contain switching means to switch any portion of the meander line length. FIG. 3 shows some of the possible modes, such as horizontal polarization or loop mode, obtained when the antenna is operated at a frequency such that the electrical length of the entire line including the meander lines 200 is a multiple of full wavelength as shown in FIG. 3C.

Figure 3A:
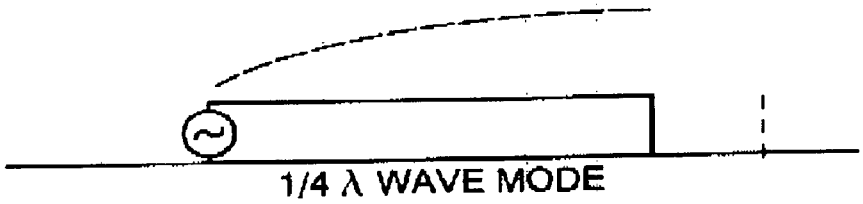
FIG. 3A (PRIOR ART)
FIGS. 3A–3D are a series of comparative diagrams showing various possible operating modes of the antenna of FIG. 1.
Figure 3B:
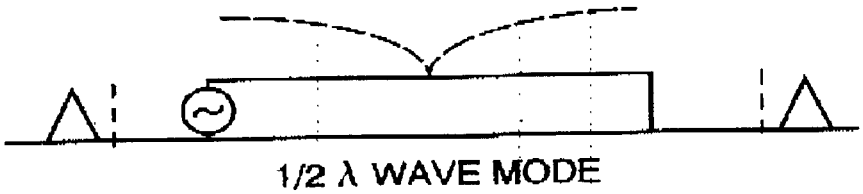
FIG. 3B (PRIOR ART)
Figure 3C:
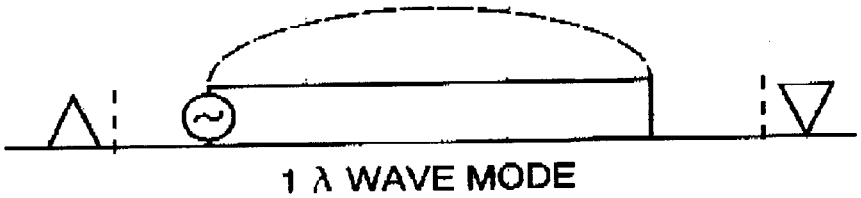
FIG. 3C (PRIOR ART)
Figure 3D:
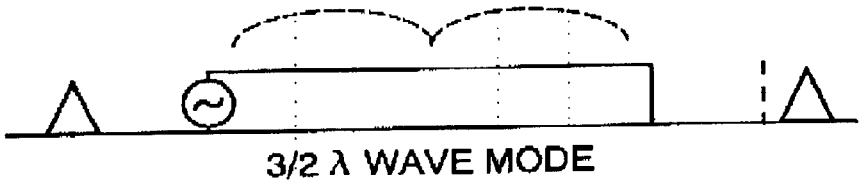
FIG. 3D (PRIOR ART)

The antenna can also be operated in a vertically polarized mode, monopole mode, by adjusting the electrical length to an odd multiple of a half wavelength at the operating frequency, FIGS. 3B and 3D, respectively. The meander lines 200 can be tuned using electrical or mechanical switches (not shown) to change the mode of operation at a given frequency or to switch frequencies using a given mode. The construction and operation of such antennas are described in detail in U.S. Pat. No. 5,790,080.

Figure 4:
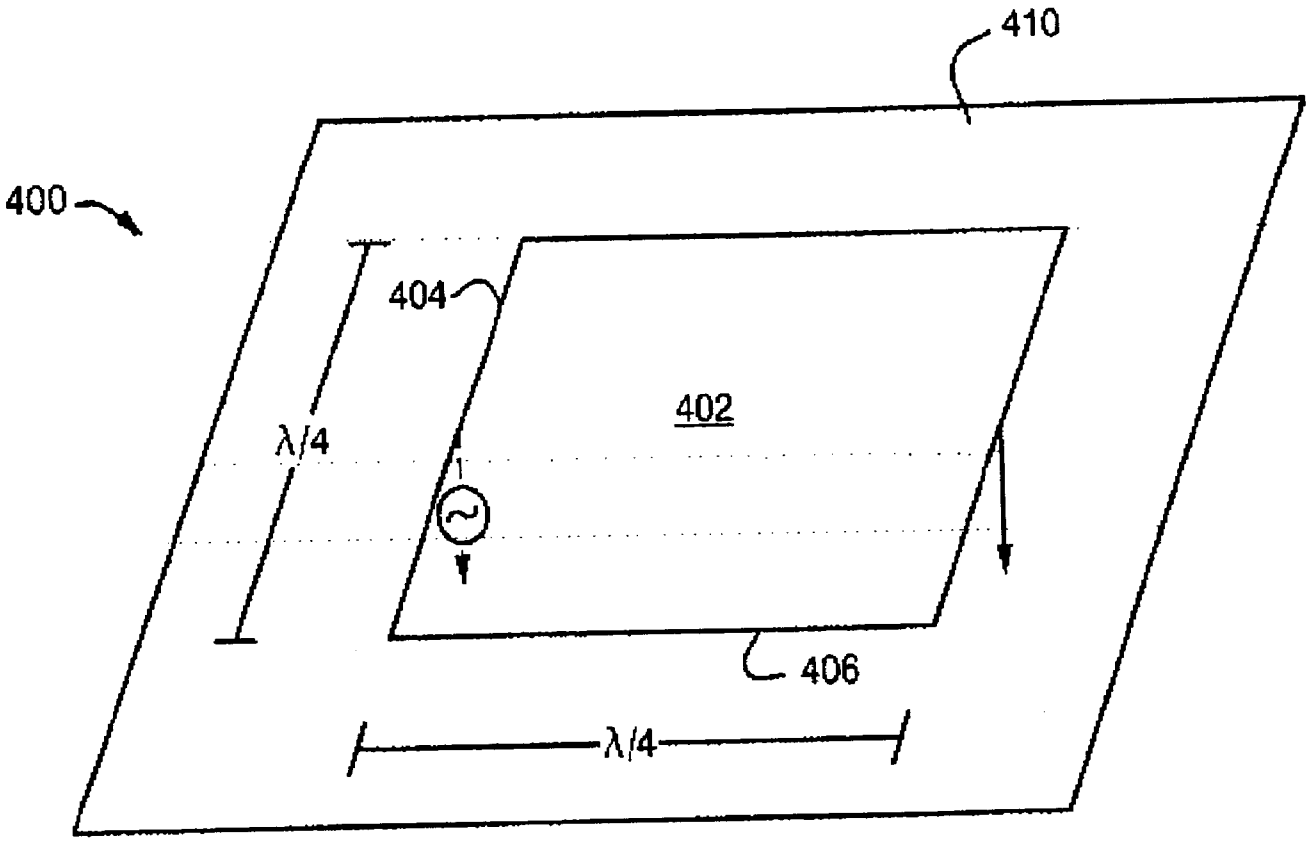
FIG. 4 (PRIOR ART)
FIG. 4 is a top plan view of a conventional patch antenna.

Referring now to FIG. 4, there is shown a conventional patch antenna, generally at reference number 400. Normally, a patch antenna 402 has a length 404 and a width 406 of one quarter (λ4) wavelength at the desired operating frequency. The patch antenna 402 is positioned above a ground plane 410. These dimensions 404, 406 make the patch antenna 402 impractical for use at typical communication frequencies, including military land vehicles and aircraft.

For example, at 3.89 MHz, a standard square patch antenna operating in quarter-wave mode would be approximately 792 inches on a side. However, the corresponding meander line tunable patch antenna built in accordance with the present invention has dimensions of only 72 inches×20 inches×7.5 inches high, a significant reduction in size. Based on experimentation, an unexpected frequency range of approximately 2–12 MHz was achieved using the much smaller meander line patch antenna.

In the preferred embodiment a meander line antenna is designed as a patch antenna by making the electrical length of the antenna equal to one-quarter wavelength at the resonant (i.e., operating) frequency. As explained herein, the actual length of the antenna is significantly smaller that the electrical length by utilizing the internal meander lines.

Figure 5:
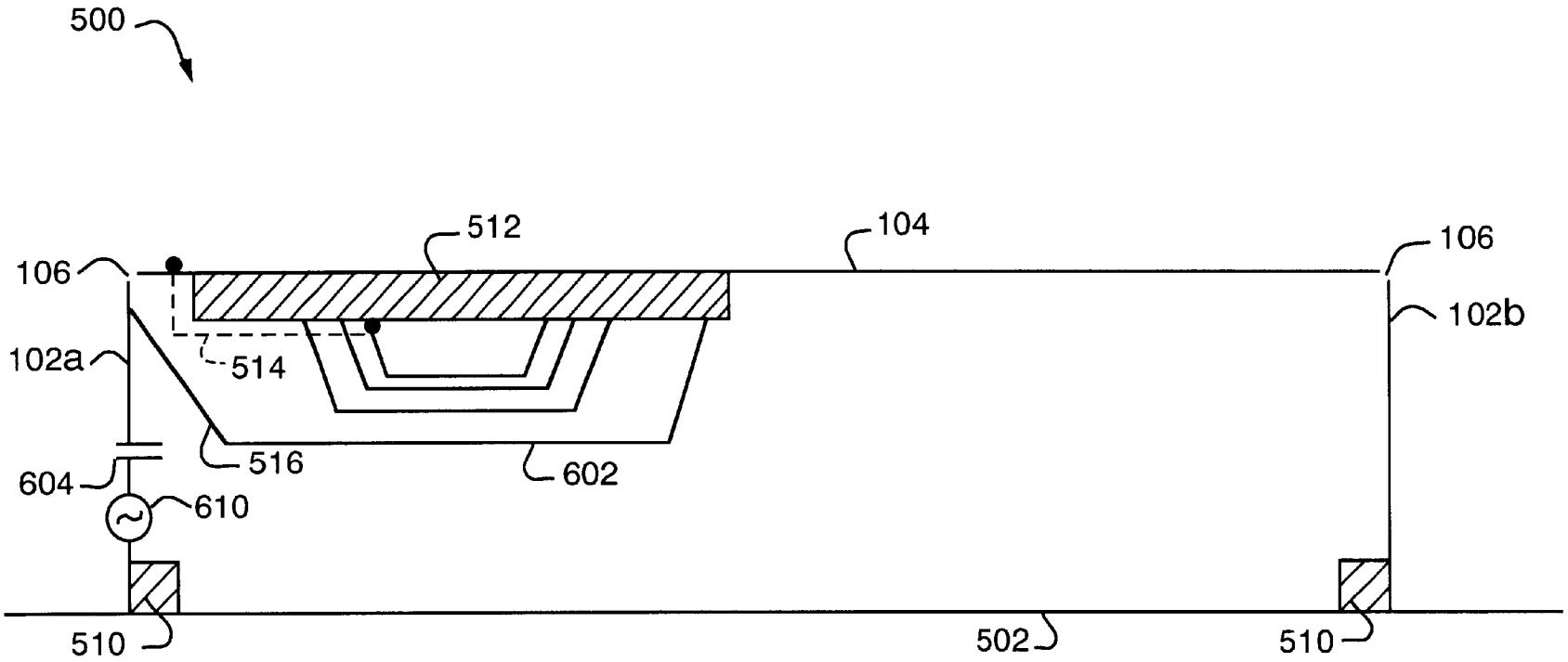
FIG. 5 is a schematic cross sectional view showing construction details of the inventive antenna.

Referring now to FIG. 5, there are shown the construction details of the inventive meander line loaded patch antenna 500. The vertical radiating plates 102*a*, 102*b* are attached to the ground plane 502. For attaching the vertical radiating plate 102*a*, 102*b* to ground plane 502, welding or soldering are suitable attachment methods as well as other methods known in the art. In one embodiment support structures 510 are used to position the vertical radiating plates 102*a* and/or 102*b* to ground plane 502. The support structures 510 are square or rectangular section of either a dielectric or a conductor, since these plates 102*a*, 102*b* are grounded to the ground plane 502.

The horizontal radiating plate 104 is positioned perpendicular to and between the vertical plates 102*a*, 102*b*, but separated by gaps 106. Rectangular sections of dielectric material 510 (e.g., Teflon7, polyethylene or phenolic) can be used at the gaps 106 to maintain the spacing of the gap and provide structural strength to the structure. The plates 102*a*, 102*b*, 104 are fastened to the dielectric material 510, 512 with adhesives, screws, or bolts (not shown).

A meander line 602 is attached to the top radiating plate 104 by means of a generally rectangular sheet of dielectric 512 used to provide support for the meander line 602 while electrically isolating it from the radiating plate 104. The dielectric used and the gap between the plates at these locations should be sufficient to prevent field breakdown at the field strengths for which the antenna is designed to operate. In a preferred embodiment the dielectric sheet 512 extends to the vertical plate 102*a* for structural integrity and therefore does not need a separate dielectric bar 510. The meander line extends the electrical length of the antenna and has a number of loop sections as discussed in the prior art, with a means for switching in various sections to adjust the electrical length. One end of the meander line 516 connects to the vertical plate and the other end of the meander line 514 connects to the horizontal plate 104.

The meander line should be located to bridge the gap 106, but the attachment location need not be the top plate 104, as shown. Other locations on the top radiating plate 104, the vertical radiating plates 102*a*, 102*b*, or the ground plane 502 can also be used if that location is more convenient for a particular implementation of the antenna 500.

If the meander line 602 is manufactured using printed circuit techniques on printed circuit board material, it could be designed to attach directly to the top radiating plate 104, for example, by soldering or using screws. In this approach one side of the printed circuit board material would be in contact with the top plate 104 and the other side of the printed circuit board would have the meander line circuit etched into it. The board material itself would act as the dielectric insulator.

Figure 6:
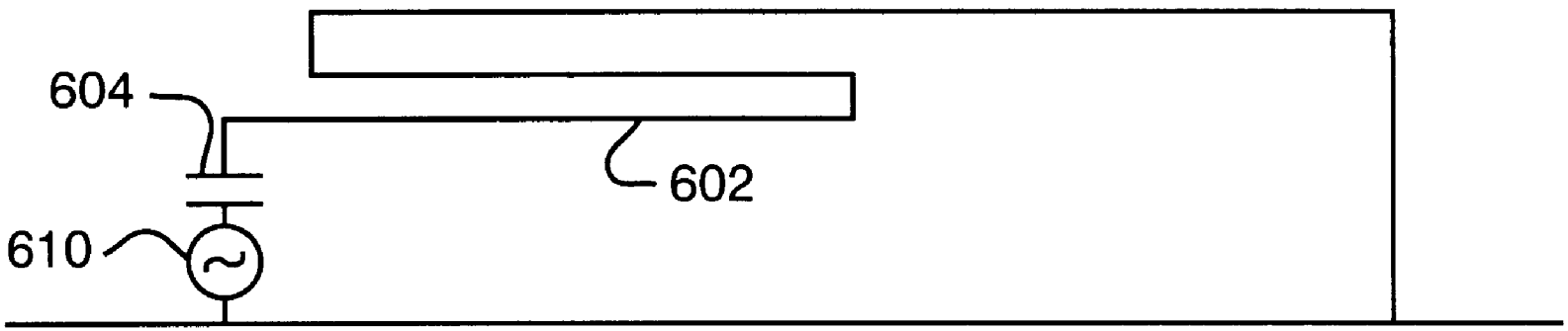
FIG. 6 is a schematic cross sectional of the tunable patch meander line loaded antenna of the invention showing series capacitors.

Referring now also to FIG. 6, there is shown a schematic, cross-sectional view of a meander line 602 as applied to a patch antenna 402 (FIG. 4). Meander line 602 is used to adjust the electrical length of the antenna 402. However, this meander line 602 adds inductance, which can be canceled by adding a capacitor 604. The capacitor 604 is sized to compensate for the inductive reactance (i.e., reduce the inductive reactance to substantially 0 ohms) of the antenna at the point where the antenna resistance is 50 ohms. When these changes are made, the efficiency of the antenna is reduced. However, the reduced dimensions of the meander line antenna result in a conformal antenna that is practical on mobile platforms at typical communications frequencies. The benefit of reduced size generally outweighs the disadvantages of the reduced efficiency for many applications.

One embodiment of a practical MLA patch antenna employs switches (not shown) to add or remove sections of the meander line 602 as a way to vary its electrical length to change the resonant frequency of the antenna. These switches can be microelectromechanical systems (MEMS) switches, diodes, relays, or any other switching device suitable for operation at the operating frequency of the antenna. Such switching devices are all well known to those of skill in the antenna design arts.

The switches (not shown) are typically located in the high impedance sections of the meander line 602 where currents are relatively low. The high current sections are the top plate 104 and the grounded vertical section 102*b*. Placing switches in these locations results in very low switch losses. The capacitance generally need not be adjusted as the meander line length is changed over approximately a three to one frequency range (i.e., the same capacitance value can be used for a broader frequency range). For tuning over larger frequency ranges, switches can be used to adjust series capacitance needed to cancel the meander line inductance.

Figure 7:
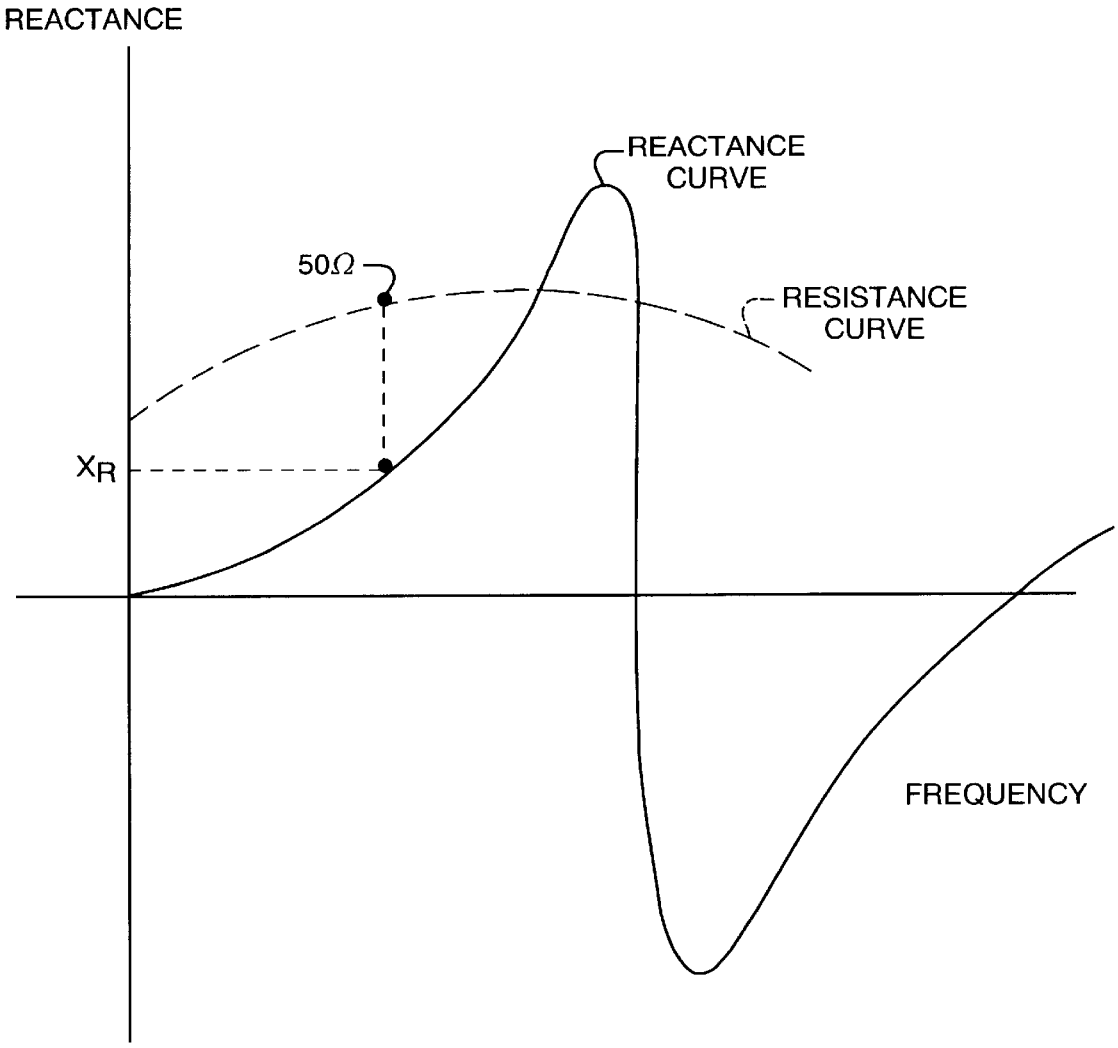
FIG. 7 is a graphical presentation of the illustrating the reactive elements of the meander line loaded antenna.

FIG. 7 is a graphical representation of the reactance of the horizontal and vertical radiating elements of the meander line loaded antenna 602. The reactance and resistance curves illustrate the capacitance selection. At the 50 ohm point on the resistance curve $X_R$ represents the value wherein the inductance plus the capacitance are matched such that the sum equals zero. Using the capacitance value of $X_R$ will effectively cancel the meander line inductance.

In one embodiment the mode excited in the inventive antenna is the so-called inverted "L" mode in which the current is high on the horizontal section and the grounded vertical section. The inverted L refers to the shape of the high conducting horizontal section 104 and vertical side 102*b* without the feed. The physical size of the antenna at 2 MHz would be approximately:

| | |
|---|---|
| Height | 12 inches |
| Width | 20 inches |
| Length | 60 inches |

since A=150 meters.

This is exceedingly small when compared to the normal patch antenna of the prior art, which would have a length and width of 37.5 meters each.

Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A meander line loaded tunable patch antenna, comprising:

a) a pair of vertical sections disposed substantially perpendicular to a ground plane, at least one of said pair of vertical sections being electrically connected to said ground plane; a substantially horizontal top section disposed above and substantially perpendicular to said pair of vertical sections, each end of said top section being proximate one of said pair of vertical sections and electrically separated therefrom by a gap;

b) at least one meander line proximate at least one of said gaps and operatively connected to one of said vertical sections and to said top section, said meander line comprising at least two portions selectively electrically connectable one to the other;

c) meander line switching means disposed between said at least two portions of said meander line for electrically connecting a first of said at least two portions to a second of said at least two portions; and d) at least one series capacitor operatively connected to at least one of said at least two portions of said meander line.

2. The meander line loaded tunable patch antenna according to claim 1, wherein said meander line switching means comprises at least one from the group:

diode, relay, microelectromechanical systems (MEMS) switch.

3. The meander line loaded tunable patch antenna according to claim 1, wherein said at least one series capacitor operatively connected to at least one of said at least two portions of said. meander line is calculated to effectively cancel a meander line inductance, whereby said meander line loaded tunable patch antenna has physical dimensions much smaller than one quarter wavelength at a predetermined operating frequency and is tuned by selectively electrically adding and removing at least one of said at least two portions of said meander line using said meander line switching means.

4. The meander line loaded tunable patch antenna according to claim 1, wherein said series capacitor comprises at least two series capacitors, at least one of said at least two series capacitors being operatively connected to said at least one meander line by a capacitance switching means.

5. The meander line loaded tunable patch according to claim 4, wherein said capacitance switching means comprises at least one from the group:

diode, relay, microelectromechanical systems (MEFMS) switch.

6. The meander line loaded tunable patch antenna according to claim 4, wherein said at least two series capacitors are calculated to effectively cancel a meander line inductance by selectively electrically adding and removing said at least two series capacitors using said capacitance switching means.

7. The meander line loaded tunable patch antenna according to claim 1, wherein said meander line switching means are located on a high impedance section of said at least two portions of said meander line.

8. The meander line loaded tunable patch antenna according to claim 1, wherein said at least one meander line is affixed to a sheet of dielectric material disposed between said at least one meander line and said horizontal top section.

9. The meander line loaded tunable patch antenna according to claim 1, further comprising sections of dielectric material disposed at a junction between said pair of vertical sections and said ground.

10. The meander line loaded tunable patch antenna according to claim 1, further comprising sections of dielectric material disposed at each said gap.

11. A meander line loaded tunable patch antenna, comprising:

a) a pair of vertical sections disposed substantially perpendicular to a ground plane, at least one of said pair of vertical sections being electrically connected to said ground plane; a substantially horizontal top section disposed above and substantially perpendicular to said pair of vertical sections, each end of said top section being proximate one of said pair of vertical sections and electrically separated therefrom by a gap;

b) at least one printed circuit meander line proximate at least one of said gaps and operatively connected to one of said vertical sections and to said top section, said meander line comprising at least two portions selectively electrically connectable one to the other;

c) meander line switching means disposed between said at least two portions of said meander line for electrically connecting a first of said at least two portions to a second of said at least two portions; and d) at least one series capacitor operatively connected to at least one of said at least two portions of said meander line.

12. The meander line loaded tunable patch antenna according to claim 11, wherein said at least one printed circuit meander line is attached directly to said horizontal top section.

13. The meander line loaded tunable patch antenna according to claim 11, wherein said at least one printed circuit meander line is attached directly to one of said pair of vertical sections.

14. The meander line loaded tunable patch antenna according to claim 11, wherein said meander line switching means comprises at least one from the group:

diode, relay, microelectromechanical systems (MEMS) switch.

15. The meander line loaded tunable patch antenna according to claim 11, wherein said at least one series capacitor operatively connected to at least one of said at least two portions of said meander line is calculated to effectively cancel a meander line inductance, whereby said meander line loaded tunable patch antenna has physical dimensions much smaller than one quarter wavelength at a predetermined operating frequency and is tuned by- selectively electrically adding and removing at least one of said at least two portions of said meander line using said meander line switching means.

16. The meander line loaded tunable patch antenna according to claim 11, wherein said series capacitor comprises at least two series capacitors, at least one of said at least two series capacitors being operatively connected to said at least one meander line by a capacitance switching means.

17. The meander line loaded tunable patch according to claim 16, wherein said capacitance switching means comprises at least one from the group;

diode, relay, microelectromechanical systems (MEMS) switch.

18. The meander line loaded tunable patch antenna according to claim 16, wherein said at least two series capacitors are calculated to effectively cancel a meander line inductance by selectively electrically adding and removing an at least two series capacitors using said capacitance switching means.

19. The meander line loaded tunable patch antenna according to claim 11, wherein said meander line switching means are located on a high impedance section of said at least two portions of said meander line.

20. The meander line loaded tunable patch antenna according to claim 11, further comprising sections of dielectric material disposed at a junction between said pair of vertical sections and said ground.

* * * * *